United States Patent [19]

Stone

[11] 4,115,881

[45] Sep. 26, 1978

[54] TOILET FLUSHING ASSEMBLY

[76] Inventor: Andrew Joseph Stone, 457 Beach 124th St., New York, N.Y. 11694

[21] Appl. No.: 818,637

[22] Filed: Jul. 25, 1977

[51] Int. Cl.[2] ..... E03D 1/14

[52] U.S. Cl. ..... 4/326; 4/415

[58] Field of Search ..... 4/67 A, 249, 250, 67 R, 4/56, 326, 325, 324, 415, 395, 396

[56] References Cited

U.S. PATENT DOCUMENTS

| | | | |
|---|---|---|---|
| 2,351,672 | 6/1944 | Engel | 4/67 A |
| 3,768,103 | 10/1973 | Robinson | 4/67 A |
| 3,964,109 | 6/1976 | Street et al. | 4/67 A |
| 4,017,912 | 4/1977 | Young | 4/67 A |
| 4,042,982 | 8/1977 | Contreras | 4/67 A |

*Primary Examiner*—Richard E. Aegerter
*Assistant Examiner*—L. Footland
*Attorney, Agent, or Firm*—Allison C. Collard; Thomas M. Galgano

[57] ABSTRACT

An improved toilet flushing assembly is provided of the type which includes a water tank, a water discharge pipe disposed at least partially within the tank, and which has an opening at the upper end thereof, defining a primary flush valve seat, a flush valve ball communicative with the flush valve seat, means for moving the flush valve ball between an open and closed position relative to the primary flush valve seat, and a generally upstanding overflow pipe disposed within the tank and having a lower open end which communicates with the discharge pipe. The improved assembly provides an overflow pipe having an opening therein disposed at a level above the primary valve seat, which opening defines a secondary flush valve seat. A movable valve member is disposed within the tank for communication with the secondary valve seat and means are provided for moving the valve member between an open and closed position relative to the secondary flush valve seat, so as to permit, in the open position thereof, a partial discharge of the water held in the tank through the overflow pipe and, in turn, the discharge pipe, while the primary flush valve ball remains in a closed position relative to the primary valve seat.

2 Claims, 4 Drawing Figures

TOILET FLUSHING ASSEMBLY

This invention relates to an improved toilet flushing assembly. More particularly, it relates to an improved toilet flushing assembly which permits a partial discharge of the water contained in the tank.

Toilet flushing assemblies are, of course, well known in the art. Typically, they include a water tank, a water discharge pipe disposed at least partially within the tank and having an opening at the upper end thereof, defining a primary flush valve seat, and a flush valve ball communicative with the primary flush valve seat. Means are also provided for moving the flush valve ball between an open and closed position relative to the primary flush valve seat, to respectively permit the discharge and containment of the water introduced into the tank. Usually, these means include an external, pivotable handle mounted on the water tank which is coupled to a generally horizontally disposed trip arm located within the tank which, in turn, supports a generally vertically disposed trip hook or wire. The trip wire is connected to the shaft of the flush valve ball and, upon the pivoting of the handle and trip arm, raises the flush valve ball to permit discharge of the water to the toilet bowl. While devices of this type have worked quite well and are widely used, they have been found to be generally unsatisfactory in that they always permit a full discharge of water from the tank, which is often not required. This results in the wasteful use of considerable amounts of water, as well as in increased operational costs.

While attempts have been made to improve upon the above-noted deficiency, the assemblies proposed are generally complicated and are not easily adapted to existing, conventional flushing assemblies. Some require a complete redesign of an existing toilet assembly, while others have rather complicated constructions. In addition, so far as is known, no presently available flushing assembly deals with this problem in the highly effective, yet relatively simple manner herein proposed.

Accordingly, it is an object of the present invention to provide an improved toilet flushing assembly, which permits the partial discharge of water from the water tank, so as to minimize water usage and operational costs.

It is also an object of the present invention to provide such an improved toilet flushing assembly, which is easily adaptable to existing toilet flushing assemblies.

It is a further object of the instant invention to provide such an improved flushing assembly, which is simple in operation, highly reliable, durable and easy to install.

It is still another object of the present invention to provide such an improved flushing assembly, which is economical and may be constructed from readily available, commercially produced parts.

Certain of the foregoing and related objects are readily attained in a toilet flushing assembly of the type which includes a water tank, a water discharge pipe disposed at least partially within the tank and having an opening at the upper end thereof, defining a primary flush valve seat, a flush valve ball communicative with the primary flush valve seat, means for moving the flush valve ball between an open and closed position relative to the primary flush valve seat, to respectively permit the discharge and the containment of the water introduced into the tank, and a generally upstanding overflow pipe disposed in the tank and having a lower open end which communicates with the discharge pipe. The improved toilet flushing assembly provides an overflow pipe having an opening therein disposed at a level above the primary flush valve seat, which opening defines a secondary flush valve seat. A movable valve member is disposed within the tank for effecting sealing engagement with the secondary valve seat, and means are provided for moving the valve member between an open and closed position relative to the secondary flush valve seat. As a result, when the valve member is moved to an open position, a partial discharge of the water contained in the tank is effected through the overflow pipe and, in turn, the discharge pipe, while the flush valve ball remains in a closed position relative to the primary valve seat.

Preferably, the means for moving the valve member includes a float member, a pivotal rocker arm having a first leg to which the float member is secured, and a second leg disposed beneath the first leg, to which the valve member is secured. The means also include means for pivoting the rocker arm in a first direction to permit movement of the valve member from the closed to the open position thereof, so as to permit partial discharge of the water contained in the tank. Upon partial discharge, the float member is lowered as the water level drops and causes pivotal movement of the rocker arm in a second direction, opposite to that of the first direction to, in turn, cause movement of the valve member from the open to the closed position thereof. The assembly is thus automatically set for repetition of the flushing cycle.

Most advantageously, the rocker arm is pivotally mounted on the overflow pipe, and the means for moving the rocker arm includes a pivotal handle mounted externally on the tank, a generally horizontally disposed, elongated trip arm mounted withint the tank, one end of which is coupled to the handle to permit pivotal movement of the trip arm about the inner end thereof, and an elongated trip hook, secured to the trip arm, having a lower depending end which engages a third leg of the rocker arm.

In a preferred embodiment of the invention, the overflow pipe has a cylindrical flange extending laterally outwardly therefrom, having an outer, open end which defines the secondary flush valve seat, and the valve member comprises a generally cup-shaped element having a channelled rim which sealingly engages the outer end of the flange in the closed position thereof. Most desirably, the rocker arm has a generally S-shaped configuration, the upper and lower ends of which define, respectively, the third and second legs thereof, with the first leg being disposed between the upper and lower ends thereof.

Other objects and features of the present invention will become apparent from the following detailed description, when taken in connection with the accompanying drawings, which disclose a single embodiment of the invention. It is to be understood that the drawings are designed for the purposes of illustration only, and are not intended as a definition of the limits and scope of the invention disclosed.

In the drawings, wherein similar reference numerals denote similar elements throughout the several views.

Figure 2:
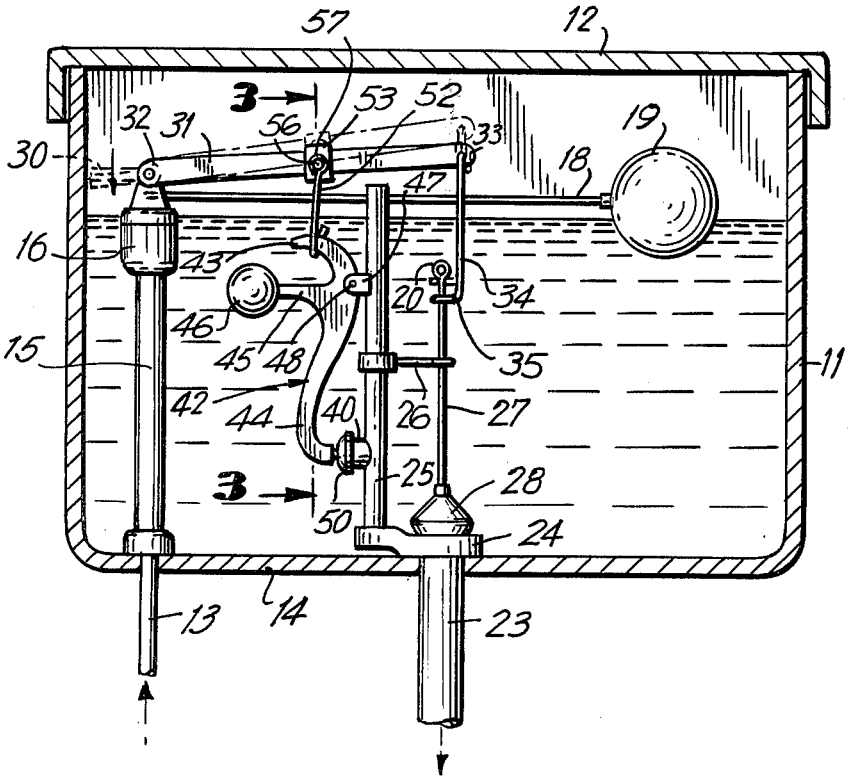
FIG. 2 is a cross-sectional view, in part elevation, taken along line 2—2 of FIG. 1, illustrating the improved flushing assembly embodying the present invention.
Figure 5:
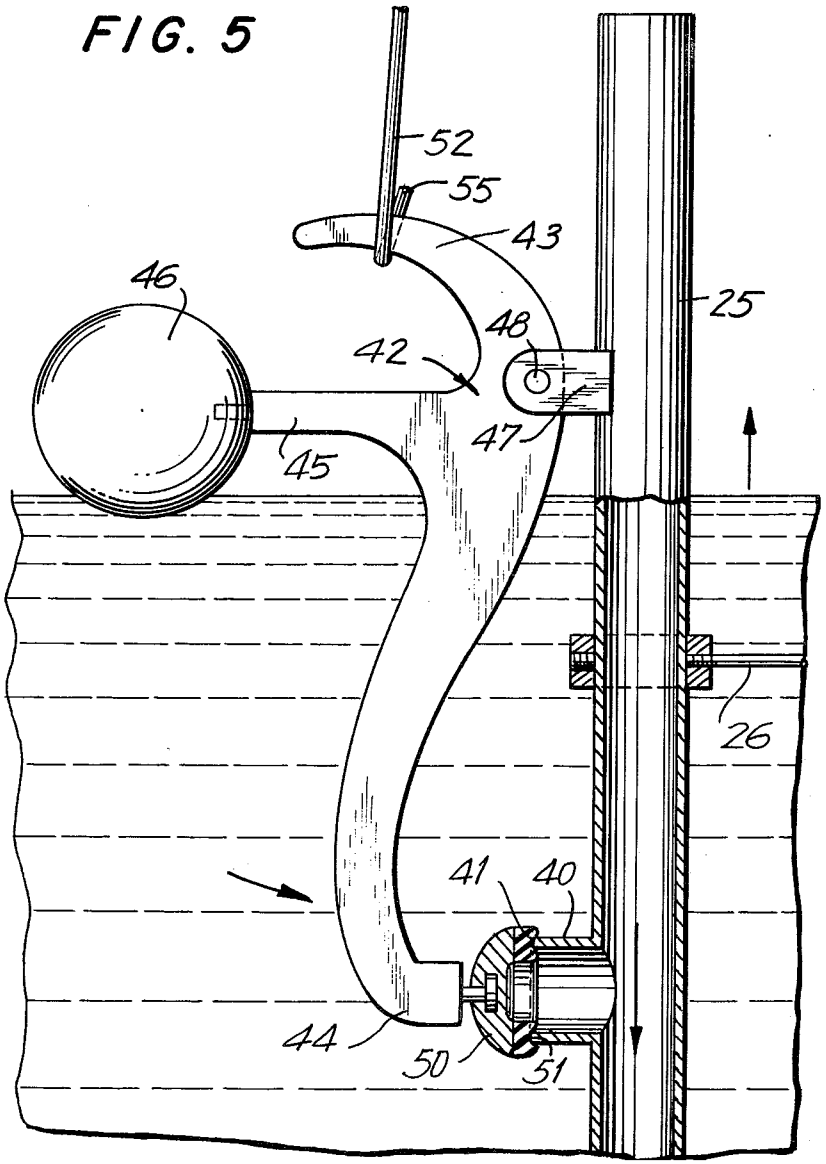
Figure 4:
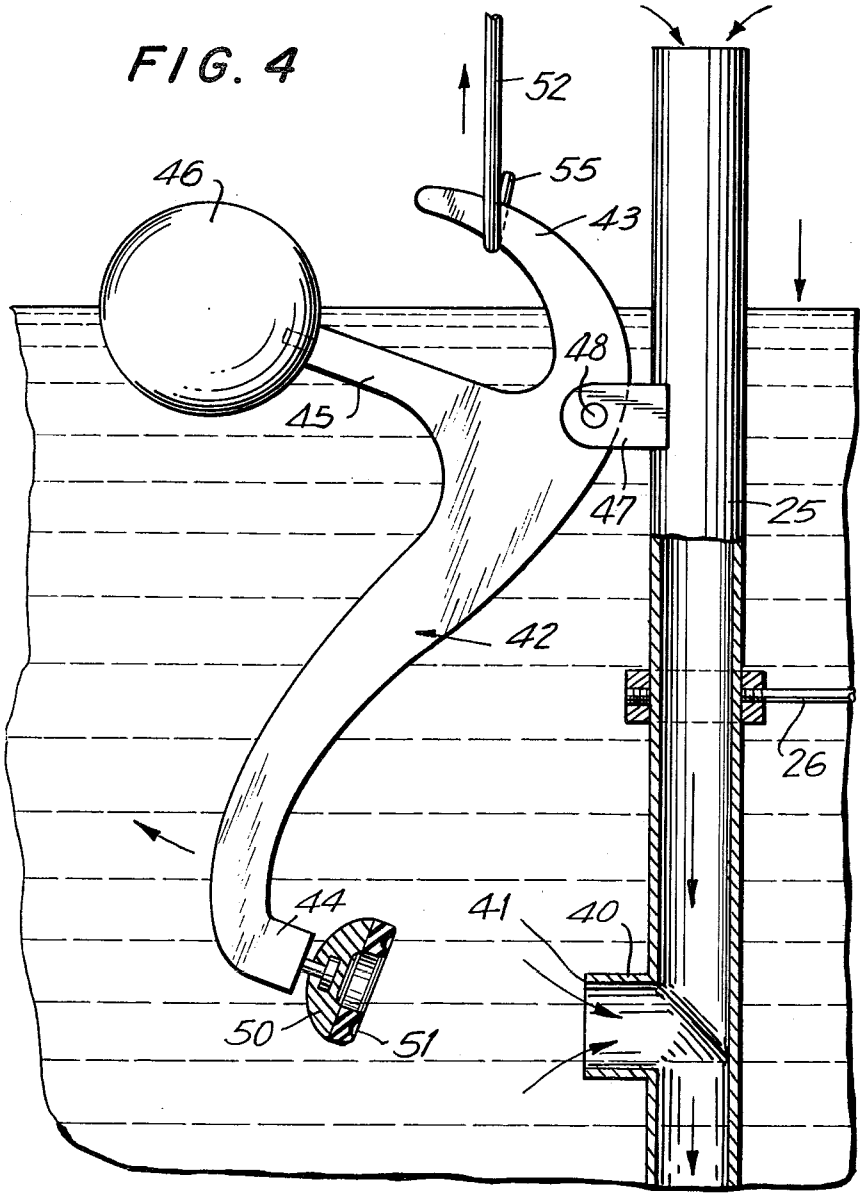

FIG. 4 is an enlarged, fragmentarily-illustrated elevational view, in part section, of a portion of the flushing assembly shown in FIG. 2 and illustrating movement of the rocker arm to an open position, to effect a partial discharge of the water contained in the tank; and FIG. 5 is a view similar to that of FIG. 4, but showing pivotal movement of the rocker arm to a closed position to effect stopping of the partial discharge of water.

Figure 1:
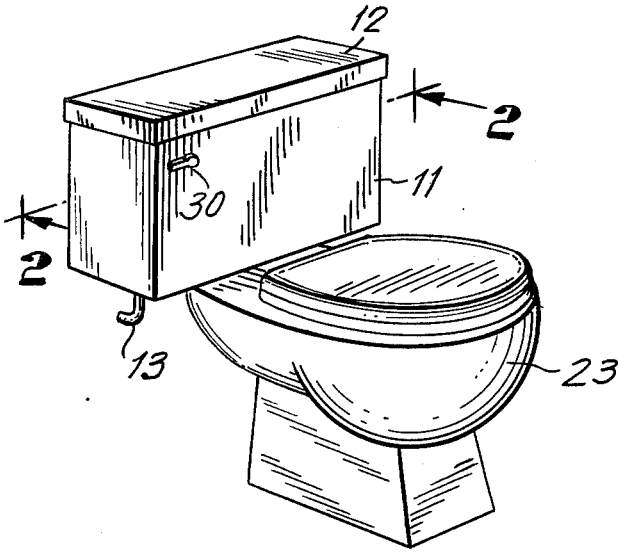
FIG. 1 is a perspective view of a toilet in which the improved toilet flushing assembly embodying the present invention, is installed.

Turning now in detail to the appended drawings, therein illustrated is a novel toilet flushing assembly, embodying the present invention, which is installed in a conventional toilet, such as that shown in FIG. 1. As can be seen more clearly in FIG. 2, the toilet includes a generally rectangular water tank 11 having a lid 12. Tank 11 is supplied with water by means of a water supply pipe 13. Water supply pipe 13 extends through the base 14 of tank 11 and is coupled to an upstanding inlet pipe 15, the top end of which supports an inlet valve 16. A movable inlet valve plunger (not illustrated) is disposed for communication with inlet valve 16. The valve plunger is coupled to a float arm 18 of a float 19, which rises and falls relative to the water level in tank 11. As water enters tank 11 through inlet valve 16, the water level and, in turn, float 19 will rise until it reaches a predesired level, at which point it will cause the inlet valve plunger to be pushed down into inlet valve 16, thus cutting off the supply of water. Conversely, when the water is flushed from tank 11, causing the water level to fall, float 19 will drop and, in turn, lift the valve plunger and open inlet valve 16, to permit filling of tank 11 with water.

Water is discharged to the toilet bowl 22 by means of a drain pipe 23, the upper end of which extends through base 14 of tank 11, and opens into the interior of tank 11, to define a flush valve seat 24. The upper end of drain pipe 23 is also connected to an upstanding overflow pipe 25. A flush valve shaft bracket 26 is mounted on pipe 25, and slidably supports a flush valve ball shaft 27 of a flush valve ball 28. Flush valve ball 28 normally sits on valve seat 24, to prevent the discharge of water from tank 11. Flush valve ball 28 is raised off flush valve seat 24 by means of a toilet flushing assembly, which includes a pivotable handle 30 mounted externally of tank 11 (see FIG. 1), an elongated trip arm 31 which is generally horizontally disposed within tank 11, and which has an inner end 32 which is coupled to handle 30, and a generally vertically disposed trip wire 34, which is supported on the outer end 33 of trip arm 31 and which has a depending lower bent eyelet end, which is slidably supported on flush valve shaft 27 between the mounting bracket 26 and the upper abutment end 20 of valve shaft 27.

By depressing handle 30, the outer end 33 of trip arm 31 will pivot upwardly about its inner end 32, lifting trip wire 34 and, in turn, flush valve shaft 27 and flush valve ball 28, thereby permitting the water to run from tank 11 through drain pipe 23 and to bowl 23. As the water is flushed from tank 11, the flush valve ball 28, guided by its shaft 27 and bracket 26, will drop and come to rest atop valve seat 24, thereby shutting off the discharge of water from tank 11. Concurrently, due to the drop of water level, float 19 will be lowered to open inlet valve 16 and thereby permit tank 11 to be refilled. Typically, a bowl refill pipe (not shown) is provided between the inlet valve 16 and overflow pipe 25, which permits bowl 23 to be refilled during refilling of tank 11; overflow pipe 25 providing a connection to drain pipe 23 which bypasses valve seat 24.

Figure 3:
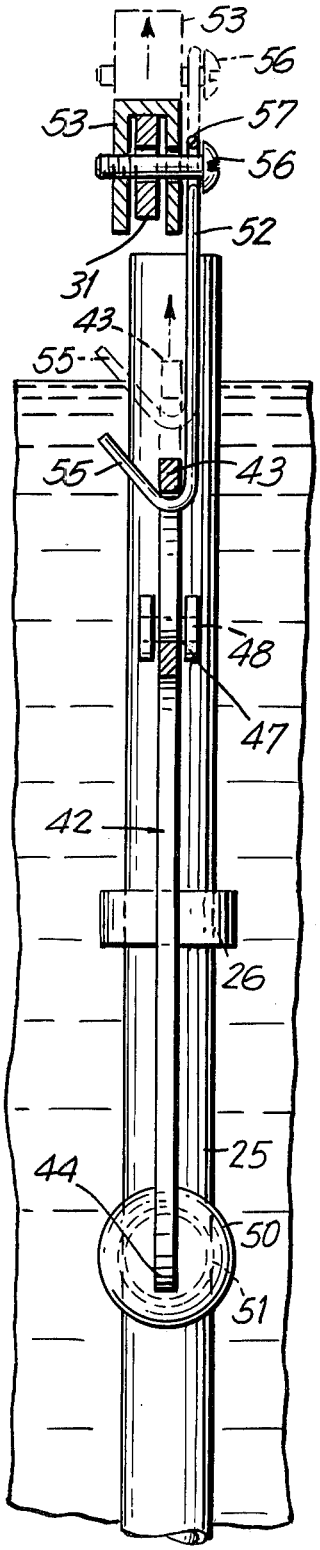
FIG. 3 is an enlarged, elevational view, in part section, taken along line 3—3 of FIG. 2.

As can be appreciated, due to the foregoing construction and mode of operation, each time handle 30 is depressed, a full discharge of water is effected, which, as previously pointed out, is sometimes not needed and, in fact, wasteful. To alleviate this problem and permit a partial discharge of water, overflow pipe 25 is provided with a cylindrical flange 40, extending laterally outwardly therefrom at a level above valve seat 24 but below the desired water level, for full discharge. The outer end of flange 40 defines a secondary flush valve seat 41 (see FIG. 4), which, when opened, will only permit a partial discharge of water from tank 11. A generally S-shaped rocker arm 42 is pivotally mounted on overflow pipe 25 by means of a mounting bracket 47 and pin 48. Rocker arm 42 includes an upper leg 43 disposed above its pivot axis, a lower leg 44 disposed below its pivot axis, and a central leg 45 disposed between its upper and lower legs 43,44, which supports a secondary float 46. The lower leg 44 of rocker arm 42 supports a generally cup-shaped valve member 50, having a grooved, rubber rim 51, which is disposed for sealing engagement with secondary valve seat 41. As can be seen more clearly in FIG. 3, a generally U-shaped bracket 53 is mounted on trip arm 31 between the ends thereof, and is held at a fixed location thereon by means of a screw 56 received through both bracket 53 and arm 31. The upper eyelet end 57 of a secondary trip wire or hook 52 is supported on screw 56. Trip wire 52 has a lower, hook-shaped end 55 which is received about upper leg 43 of rocker arm 42.

When handle 30 is partially depressed, it will cause trip arm 31 to pivot upwardly about its inner end 32 and, in turn, cause trip wire 52 to be raised. The raising of trip wire 52 will, in turn, raise upper leg 43 of rocker arm 42, causing it to pivot about its pivot axis (i.e., pin 48). As a result, lower leg 44 of rocker arm 42 will be pivoted away from flange 40, in turn, causing disengagement of valve member 50 from secondary valve seat 41. Consequently, the water will flow through flange 40 and through overflow pipe 25 and drain pipe 23 and into bowl 23. While the water is being flushed, float 46 will descend with the drop in water level, causing, in turn, rocker arm 42 to pivot back and effect reseating of rim 51 of valve member 50 against secondary valve seat 41. Generally, there is a normal vacuum condition existing at seat 41, due to the fact that the overflow pipe is generally empty when not in use, and the water in tank 11 holds valve member 50 tight against seat 41, preventing leakage. If a full flush is desired, handle 30 is turned all the way, as in normal use. This causes trip arm 31 to also raise trip hook 34 and, in turn, flush valve ball 28, in the usual way; the spacing between lower end 35 of trip hook 34 and the upper abutment end 20 of flush valve shaft 27 preventing flush valve ball 28 from being raised when handle 30 is also partially depressed.

As can be appreciated, the instant flushing assembly is readily adaptable to conventional toilet flushing assemblies, requires few additional parts and only a slight modification of the conventional assembly set-up. The device can be readily installed and be made from readily-available, metallic or plastic commercial parts.

While only a single embodiment of the present invention has been shown and described, it will be obvious to those persons of ordinary skill in the art, that many changes and modifications may be made thereunto, without departing from the spirit and scope of the invention.

What is claimed is:

1. In a toilet flushing assembly of the type including a water tank, a water discharge pipe disposed at least partially within the tank and having an opening at the upper end thereof defining a primary flush valve seat, a flush valve ball, means for moving the flush valve ball between an open and closed position relative to the primary flush valve seat to respectively permit the discharge from and the containment of the water introduced into the tank, and a generally upstanding overflow pipe disposed within the tank and having a lower open end which communicates with the discharge pipe, the improvement, comprising:

said overflow pipe having an opening therein disposed at a level above said primary valve seat which opening defines a secondary flush valve seat;

a movable valve member disposed within said tank for effecting sealing engagement with said secondary valve seat; and means for moving said valve member between an open and closed position relative to said secondary flush valve seat, so as to permit in said open position thereof, a partial discharge of the water held in said tank through said overflow pipe and, in turn, said discharge pipe, while said flush valve ball remains in a closed position relative to said primary valve seat, said means for moving said valve member includes a float member, a pivotable rocker arm pivotably mounted on said overflow pipe by a mounting bracket and pin and having a first leg extending generally axially to which said float member is rigidly secured at the end of said first end remote from said bracket and pin and a second leg, disposed beneath said first leg, to which said valve member is secured and means for pivoting said rocker arm in a first direction to permit movement of said valve member from said closed to said open position thereof, so as to permit partial discharge of water contained in said tank, said float member being lowered as the water level drops and causing pivotable movement of said rocker arm in a second direction opposite to that of said first direction to, in turn, cause movement of said valve member from said open to said closed position thereof; and wherein said rocker arm includes a third leg and wherein said means for pivoting said rocker arm includes a pivotable handle mounted externally on said tank, an elongated trip arm generally horizontally disposed within the tank, one end of which is coupled to said handle to permit pivotable movement of said trip arm about said inner end thereof, and an elongated, generally vertically disposed trip hook secured to said trip arm, having a lower depending end which engages said third leg of said rocker arm; and wherein said rocker arm has a generally S-shaped configuration, the upper and lower ends of which define, respectively, said third and second legs thereof, with said first leg disposed between said upper and lower ends thereof.

2. The assembly according to claim 1, wherein said overflow pipe has a cylindrical flange extending laterally outwardly therefrom, having an outer, open end which defines said secondary flush valve seat, and wherein said valve member comprises a generally cup-shaped element having a channelled rim which sealingly engages the outer, open end of said flange when in a closed position.

* * * * *